US011566480B2

(12) United States Patent
van Kuilenburg et al.

(10) Patent No.: US 11,566,480 B2
(45) Date of Patent: Jan. 31, 2023

(54) METHOD FOR DETECTING FLUID INFLUX OR FLUID LOSS IN A WELL AND DETECTING CHANGES IN FLUID PUMP EFFICIENCY

(71) Applicant: Noble Drilling Services Inc., Sugar Land, TX (US)

(72) Inventors: Robert van Kuilenburg, Sugar Land, TX (US); Young-Wan Hong, Katy, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 166 days.

(21) Appl. No.: 16/822,419

(22) Filed: Mar. 18, 2020

(65) Prior Publication Data

US 2020/0291733 A1 Sep. 17, 2020

Related U.S. Application Data

(63) Continuation of application No. PCT/US2018/051273, filed on Sep. 17, 2018.
(Continued)

(51) Int. Cl.
*E21B 21/01* (2006.01)
*E21B 21/08* (2006.01)
*E21B 47/10* (2012.01)

(52) U.S. Cl.
CPC ..... *E21B 21/08* (2013.01); *E21B 21/01* (2013.01); *E21B 47/10* (2013.01)

(58) Field of Classification Search
CPC ..... E21B 21/01; E21B 21/019; E21B 21/08; E21B 21/082; E21B 21/085; E21B 47/10
See application file for complete search history.

(56) References Cited

U.S. PATENT DOCUMENTS 3,613,806 A 10/1971 Raymond et al.
3,833,076 A 9/1974 Griffin
(Continued)

FOREIGN PATENT DOCUMENTS

CA 2821155 A1 1/2015
EA 6054 B1 8/2005
(Continued)

OTHER PUBLICATIONS

Centrifugal Pumps, Engineering Library, Retrieved on Februrary 2022, https://engineeringlibrary.org/reference/centrifugal-pumps-fluid-flow-doe-handbook. (Year: 2022).*
(Continued)

*Primary Examiner* — Robert E Fuller
*Assistant Examiner* — Lamia Quaim
(74) *Attorney, Agent, or Firm* — Richard A. Fagin

(57) ABSTRACT

A method for identifying anomalous mud flow includes determining an operating rate of a mud pump discharging to a pipe string in a wellbore. Mud returned from the wellbore is moved to a first metering tank. Mud is moved from the first transfer tank to a mud storage tank using a first pump having a flow rate directly related to an operating rate thereof. A first parameter related to volume of mud in the first metering tank is measured. Anomalous mud flow is identified by detecting changes in the operating rate of the first pump wherein the operating rate is adjusted to maintain the first parameter substantially constant.

13 Claims, 7 Drawing Sheets

Related U.S. Application Data

(60) Provisional application No. 62/560,271, filed on Sep. 19, 2017.

(56) References Cited

U.S. PATENT DOCUMENTS

| | | | | |
|---|---|---|---|---|
| 6,257,354 | B1 | 7/2001 | Schrader et al. | |
| 6,820,702 | B2 | 11/2004 | Glaser et al. | |
| 2002/0074269 | A1 | 6/2002 | Hensley et al. | |
| 2002/0112888 | A1 | 8/2002 | Leuchtenberg | |
| 2006/0070772 | A1 | 4/2006 | deBoer | |
| 2009/0188721 | A1* | 7/2009 | Smith | C09K 8/38 175/66 |
| 2016/0084024 | A1* | 3/2016 | Dillard | E21B 21/08 175/48 |
| 2017/0356259 | A1* | 12/2017 | Culen | E21B 21/106 |

FOREIGN PATENT DOCUMENTS

| | | | |
|---|---|---|---|
| EP | 1488073 | A1 | 12/2004 |
| RU | 2065915 | C1 | 8/1996 |
| SU | 1728468 | A1 | 4/1992 |
| WO | 2009 143469 | A2 | 11/2009 |
| WO | 2015/005988 | A1 | 1/2015 |
| WO | 2016/174574 | A1 | 11/2016 |

OTHER PUBLICATIONS

Extended European Search Report dated Mar. 24, 2021, for European Application No. 18859324.8.

International Search Report and Written Opinion, International Application No. PCT/US2018/051273 dated Feb. 27, 2019.

Australian Examination Report dated Feb. 2, 2021, for Australian Application No. 2018336718.

Russian Search Report dated Dec. 15, 2020, for Russian Patent Application No. 2020112815.

First Office Action dated Dec. 16, 2020, for or Russian Patent Application No. 2020112815.

Translation of First Office Action dated Dec. 16, 2020, for or Russian Patent Application No. 2020112815.

* cited by examiner

METHOD FOR DETECTING FLUID INFLUX OR FLUID LOSS IN A WELL AND DETECTING CHANGES IN FLUID PUMP EFFICIENCY

CROSS REFERENCE TO RELATED APPLICATIONS

Continuation of International Application No. PCT/US2018/051273 filed on Sep. 17, 2018. Priority is claimed from U.S. Provisional Application No. 62/560,271 filed on Sep. 19, 2017. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of detecting flow anomalies in a well drilling fluid supply and circulation system. More particularly, the disclosure relates to methods and apparatus for detecting fluid influx into a wellbore from an exposed subsurface formation, or fluid loss from a wellbore into an exposed subsurface formation, as well as detecting changes in efficiency of pumps used to circulate drilling fluid through a wellbore during construction and/or remediation of the wellbore.

U.S. Pat. No. 6,820,702 issued to Niedermayr et al. discloses a method and system for detecting well control events. "Well control events" in the present context means entry of fluid into a wellbore drilled through subsurface formations from one or more of such formations, or loss of drilling fluid ("mud") into one or more such formations. Methods and systems such as those disclosed in the '702 patent, as well as other such systems and methods known in the art make use of differences between flow rate and/or flow volume of mud being pumped into the wellbore and the flow rate and/or flow volume of drilling fluid ("mud") returned to the surface from the wellbore. Such differences between "flow in" and "flow out" are made during times when a drilling unit is "circulating", that is, operating its drilling fluid pumps to move drilling fluid through a pipe string disposed at least part way into the wellbore. The determined differences may be used to infer fluid influx from an exposed formation and/or fluid loss into an exposed formation.

Methods and systems such as those described in the '702 patent are effective, but may require using precisely calibrated, accurate devices to measure flow rates and/or volumes into and out of the wellbore. Further, systems such as those described in the '702 patent may be used only during circulating operations, such as drilling, reaming, washing and wellbore debris removal ("hole cleaning").

Other operations performed on a wellbore, including partial or total removal of the pipe string from the wellbore and/or partial or complete insertion of the pipe string into the wellbore, collectively called "tripping" do not use the drilling unit mud pumps. However, drilling fluid is displaced from the wellbore during pipe string insertion, requiring means for collecting, processing and storing the displaced mud; at the same time, moving the pipe string into the wellbore may increase the pressure exerted on exposed formations by the column of mud in the wellbore above hydrostatic pressure (called "surge" pressure). Differences between the displacement volume of the pipe string and the actual volume of drilling fluid moved into the collecting, processing and storing means may indicate fluid loss to an exposed formation and/or fluid influx from a formation. Conversely, as the pipe string is withdrawn from the wellbore, the withdrawn pipe volume must be replaced by an equal volume of drilling fluid to maintain the column of mud at a desired elevation (e.g., at the top of the wellbore as defined by the drilling unit). Withdrawing the pipe string may reduce the pressure exerted by the column of mud (called "swab" pressure) with accompanying risk of causing a fluid influx from an exposed formation or fluid loss to an exposed formation.

Flow rate of drilling fluid into the wellbore during circulating operations as described above is preferably maintained at a predetermined value according to established wellbore construction practices. Mud pumps on many drilling units are positive displacement pumps, and more specifically may be reciprocating piston pumps. A flow rate of drilling fluid into the pipe string, and thus into the wellbore, may be inferred by the operating rate of such mud pumps. In the case of reciprocating piston pumps, a well known measure of mud pump operating rate is referred to as "strokes per minute" (SPM). When such mud pumps are new or recently reconditioned, the efficiency of the mud pumps (actual moved mud volume with respect to piston displacement volume) is generally close to unity and is substantially constant. Over time and with wear, such mud pumps may lose efficiency, thereby making correspondence between SPM and actual pumped mud volume less accurate a measure of actual pumped fluid volume.

Current drilling rig designs rely on gravity flow to transport the drilling fluid discharged from the wellbore, through a diverter, via a flowline, to mud processing equipment such as shakers. For the drilling fluid to flow with a satisfactory speed the flow line needs to have a minimum elevation angle, also taking into account the roll and pitching of floating vessels if the drilling rig is disposed on such a vessel. This limits the flexibility of the designer to locate the mud treatment equipment and consequently mud storage tanks. The drilling rig drill floor must be placed at an elevated height above the ground surface or the deck of a marine drilling platform in most cases to ensure that the mud treatment equipment does not interfere with other drilling equipment. By having greater flexibility in the placement of mud treatment equipment and mud tanks, more space-efficient drilling vessels can be built, such as vessels with the drill floor at the same height as the main deck of the platform or vessel, or with the mud treatment equipment and mud tanks in separate vessel sections.

Drilling rig components known in the art rely on mechanical and/or pneumatic means to separate drilling cuttings from the drilling fluid. In addition, known cuttings and contaminant separation devices are open to the atmosphere, thus creating a safety hazard due to combustible and toxic fumes being allowed to escape into the ambient atmosphere. By actively pumping the mud after its discharge from a wellbore, the excess pressure provided by such pumping can be used in separation equipment. This allows more types of separation principles to be used, and possibly allows the use of fully enclosed separation devices.

There is a need for methods and apparatus to detect fluid influx, fluid loss and changes in mud pump efficiency that may use as much as possible existing mud circulation system devices already disposed at the drilling unit and requiring as little as possible extra equipment.

There is a need for methods and apparatus that do not rely solely on gravity flow of returning mud, that may use as much as possible existing mud circulation system devices already disposed at the drilling unit and requiring as little as possible extra equipment.

There is a need for methods and apparatus that do not rely solely on gravity flow of mud and mechanical and/or pneumatic separation principles that may use as much as possible existing mud circulation system devices already disposed at the drilling unit and requiring as little as possible extra equipment.

SUMMARY

A method for identifying anomalous mud flow according to one aspect of the disclosure includes determining an operating rate of a mud pump having an output thereof connected to a pipe string in a wellbore. Mud returned from the wellbore, having been displaced by the mud pump through the pipe string, is moved to a first metering tank. The returned mud is moved from the first metering tank to a mud storage tank using a first transfer pump having a flow rate directly related to a measurable operating rate of the first transfer pump. A first parameter related to volume of mud in the first metering tank is measured. Mud is moved from the mud storage tank to a second metering tank using a second transfer pump. The second transfer pump has a flow rate directly related to a measurable operating rate of the second transfer pump. The second metering tank is in fluid communication with an inlet to an inlet of the mud pump. A second parameter related to volume of mud in the second metering tank is measured. Anomalous mud flow is identified by detecting changes in the measured operating rate of the first transfer pump wherein the first transfer pump operating rate is adjusted to maintain the first parameter substantially constant.

In some embodiments, the anomalous flow comprises fluid influx into the wellbore determined by detecting an increase in the operating rate of the first transfer pump.

In some embodiments, the anomalous flow comprises fluid loss to the wellbore determined by detecting a decrease in the operating rate of the first transfer pump.

In some embodiments, the first parameter comprises a measured fluid level in the first transfer tank.

In some embodiments, the first parameter comprises a weight of the first transfer tank.

Some embodiments further comprise determining a change in density of mud in the first transfer tank by detecting reduction in the weight while the measured fluid level remains constant.

Some embodiments further comprise identifying a fluid influx by determining the change in density.

Some embodiments further comprise detecting anomalous flow by detecting changes in the measured operating rate of the second transfer pump wherein the second transfer pump operating rate is adjusted to maintain the second parameter substantially constant In some embodiments, the anomalous flow comprises reduction in efficiency of the mud pump determined by detecting a reduction in operating rate of the second mud pump.

In some embodiments, the second parameter comprises a measured fluid level in the second transfer tank.

In some embodiments, the second parameter comprises a weight of the second transfer tank.

In some embodiments, the first transfer tank comprises a trip tank.

In some embodiments, the operating rate of the mud pump is determined by measuring a pump stroke rate with respect to time.

A treatment system for mud returned from a wellbore according to another aspect of the present disclosure includes a discharge line extending from the wellbore to a first metering tank proximate the wellbore. A first transfer pump is in fluid communication at an inlet thereof with the first metering tank. A discharge from the first transfer pump is connected to a flow line. The flow line extends to an inlet of returned mud treatment equipment disposed on a drilling platform distal from the wellbore.

In some embodiments, the returned mud treatment equipment is disposed in a sealed enclosure.

Some embodiments further comprise at least one sensor arranged to measure a parameter related to fluid level in the first metering tank.

Some embodiments further comprise shakers disposed proximate an outlet end of the flow line.

Some embodiments further comprise a mud treatment tank arranged to receive mud discharged through the shakers.

Some embodiments further comprise a second metering tank in fluid communication with the mud treatment tank.

Some embodiments further comprise at least one sensor arranged to measure a parameter related to fluid level in the second metering tank.

Some embodiments further comprise a second transfer pump in fluid communication between the mud treatment tank and the second metering tank.

Some embodiments further comprise a rig mud pump in fluid communication at an inlet thereof with the second transfer tank, the rig mud pump having a fluid discharge in fluid communication with a pipe string disposed in the wellbore.

DETAILED DESCRIPTION

Figure 1:
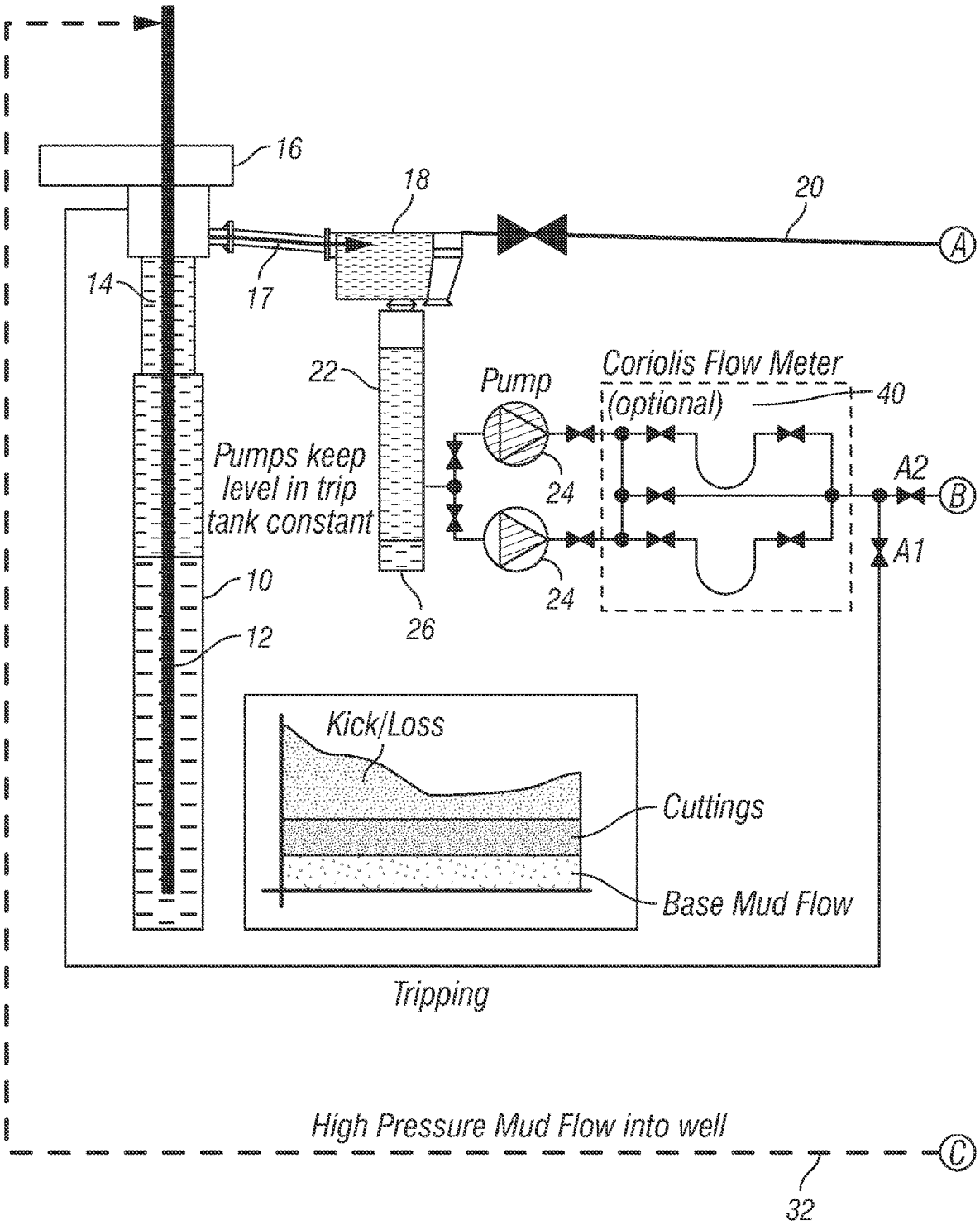
FIG. 1 shows an example embodiment of a drilling fluid circulation and processing system that may be used in accordance with the present disclosure.
Figure 1:
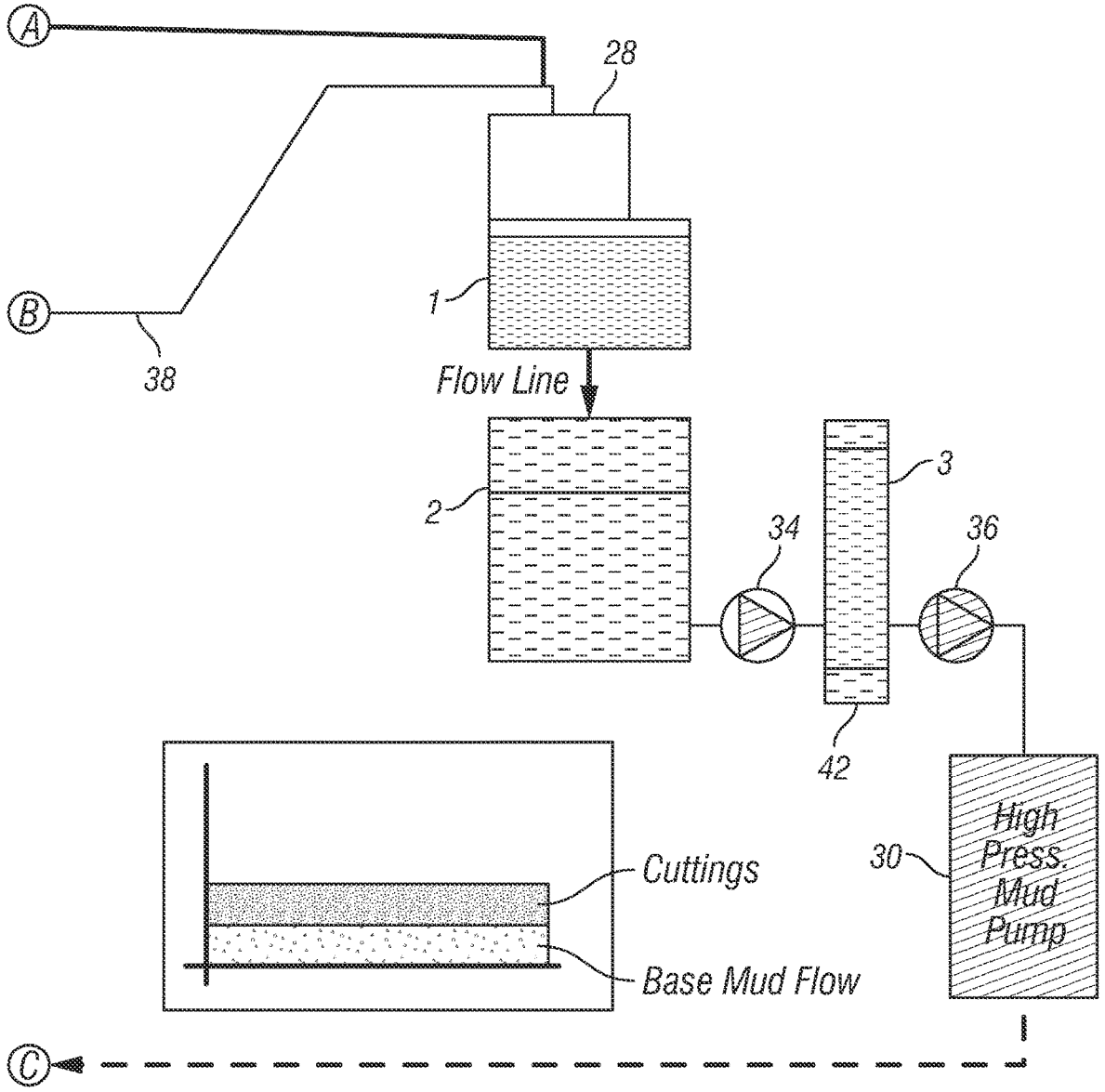

FIG. 1 shows an example embodiment of a drilling fluid circulation and processing system that may be used in accordance with the present disclosure. A drilling fluid ("mud") treatment tank 1 may comprise a plurality of individual vessels or tanks for processing mud for eventual circulation into a wellbore; a single tank is shown in FIG. 1 for clarity of the illustration. An active volume mud tank is shown at 2 and accepts processed mud from the treatment tank 1. The active volume mud tank 2 may store a volume of mud sufficient to fill the entire mud circulation system, but may have a volume small enough to enable ready detection of changes in total mud volume in the mud circulation system. One or more mud transfer pump(s) 34, for example and without limitation a disc type pump, may transfer mud from the active volume mud tank 2 to a metering tank 3. The only feature required of the mud transfer pump(s) 34 is that the volumetric flow rate of the mud transfer pump 34 is directly related to the operating speed, e.g., a rotation rate, of the mud transfer pump(s) 34 and the relationship of pump speed to volumetric flow rate is substantially constant. The metering tank 3 stores a readily determinable volume of mud, and transfers mud stored in the metering tank 3 to main rig mud pump(s) 30 using a pump such as a rotary pump 36, for example a centrifugal pump, gerotor pump or gear type pump. The type of pump used for the rotary pump 36 is not limiting; the main purpose of the rotary pump 36 is to provide enough fluid pressure at the intake of the main mud pump 30 to avoid cavitation.

During any drilling unit operation which includes active circulation of mud through all or part of a wellbore 10, the main rig mud pump(s) 30 accept(s) mud from the rotary pump 36 at an inlet of the main rig mud pump(s) 30. The main rig mud pump(s) 30 discharge(s) the mud at a selected flow rate and pressure to a standpipe and hose (shown collectively at 32) in hydraulic communication with the interior of a pipe string 12 disposed in the wellbore 10, the pipe string 12 being disposed in the wellbore 12 to a selected depth. The selected depth will depend on the particular operation taking place, e.g., drilling, reaming, washing, circulating, hole cleaning, etc. Mud is discharged proximate the lower end of the pipe string 12, for example, through a drill bit (not shown), subsequently enters the wellbore 10 and is returned to the surface through a return conduit 14 such as a drilling riser. The return conduit 14 may have a flow diverter 16 below the drilling deck of a drilling unit (omitted for clarity of the illustration) wherein mud returning from the wellbore 10 may be passed through a "gumbo box" 18 and then moved through a flow line 20 to solids separation devices such as shakers 28. After the mud passes through the shakers 28 it may be returned to the treatment tank 1 for further processing and eventual return to the active volume mud tank 2.

The mud circulation system may comprise a trip tank 22 supported on a weight sensor 26, whereby an amount of mud in the trip tank 22 may be determinable at all times. In some embodiments, the trip tank 22 may comprise a liquid level sensor (not shown) such as an acoustic or laser range finder. When used in conjunction with the weight sensor 26, a measured liquid level in the trip tank 22 may enable determination of the density of liquid ("mud weight") in the trip tank 22. Such determined density may be useful in detecting influx of different density fluids into the wellbore 10, for example, water or gas entering from a formation traversed by the wellbore 10. The trip tank 22 may be in fluid communication with an inlet of one or more trip tank transfer pumps 24. Discharge from the one or more trip tank transfer pumps 24 may in some embodiments pass through a flow meter 40, such as a Coriolis flow meter. The discharge of the trip tank transfer pumps 24 may be selectively connected to the wellbore 10 and/or to a discharge at the shakers 28 through a flow line 38. Thus, during operations in which the pipe string 12 is withdrawn from the wellbore 10 or is inserted into the wellbore 10 ("tripping operations"), an elevation level of mud in the wellbore 10 may be maintained. The elevation level may be maintained, for example, to keep the wellbore 10 completely filled.

Figure 2:
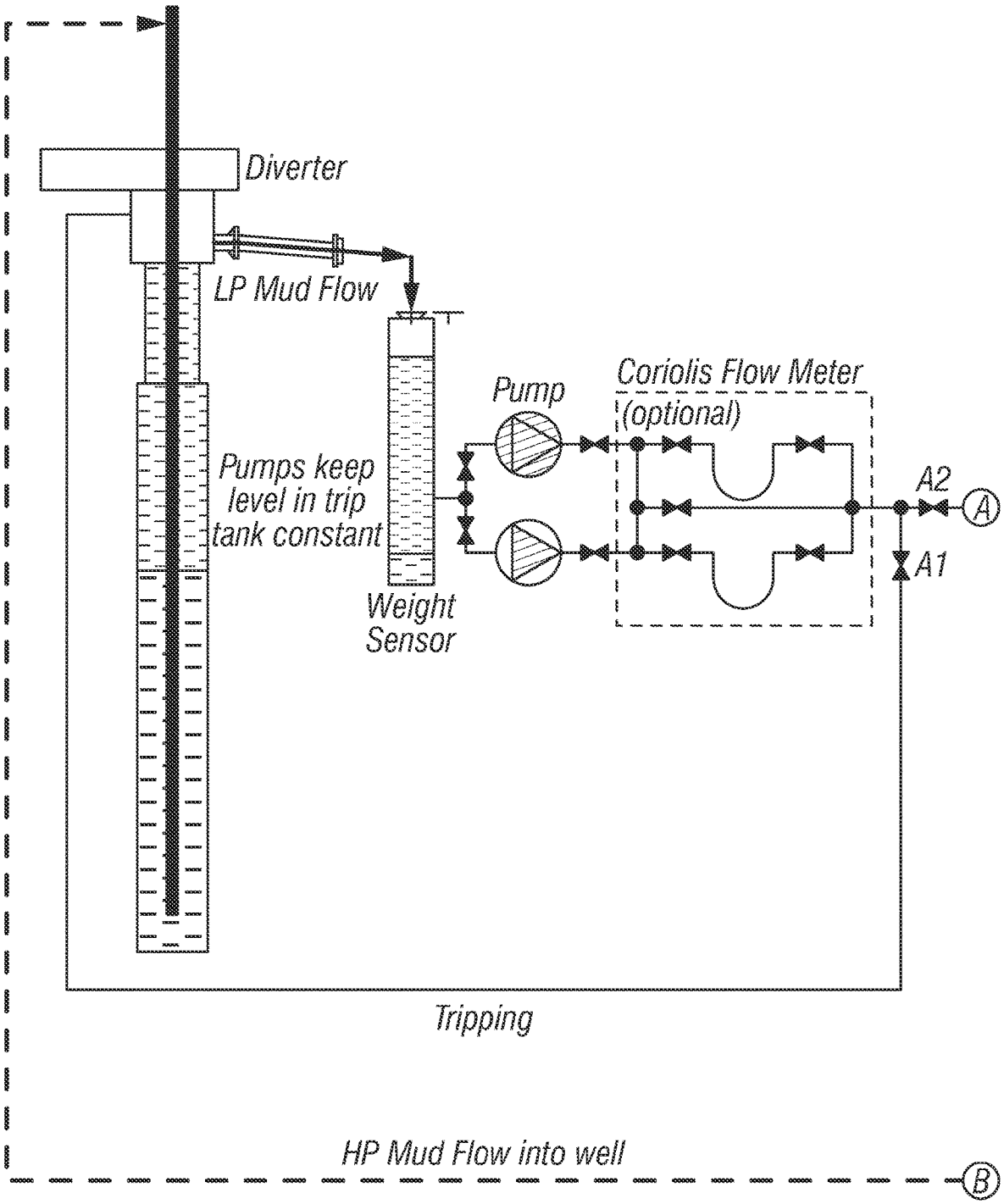
FIG. 2 shows the system of FIG. 1 wherein some of the components may be disposed at differing locations on a drilling unit.
Figure 2:
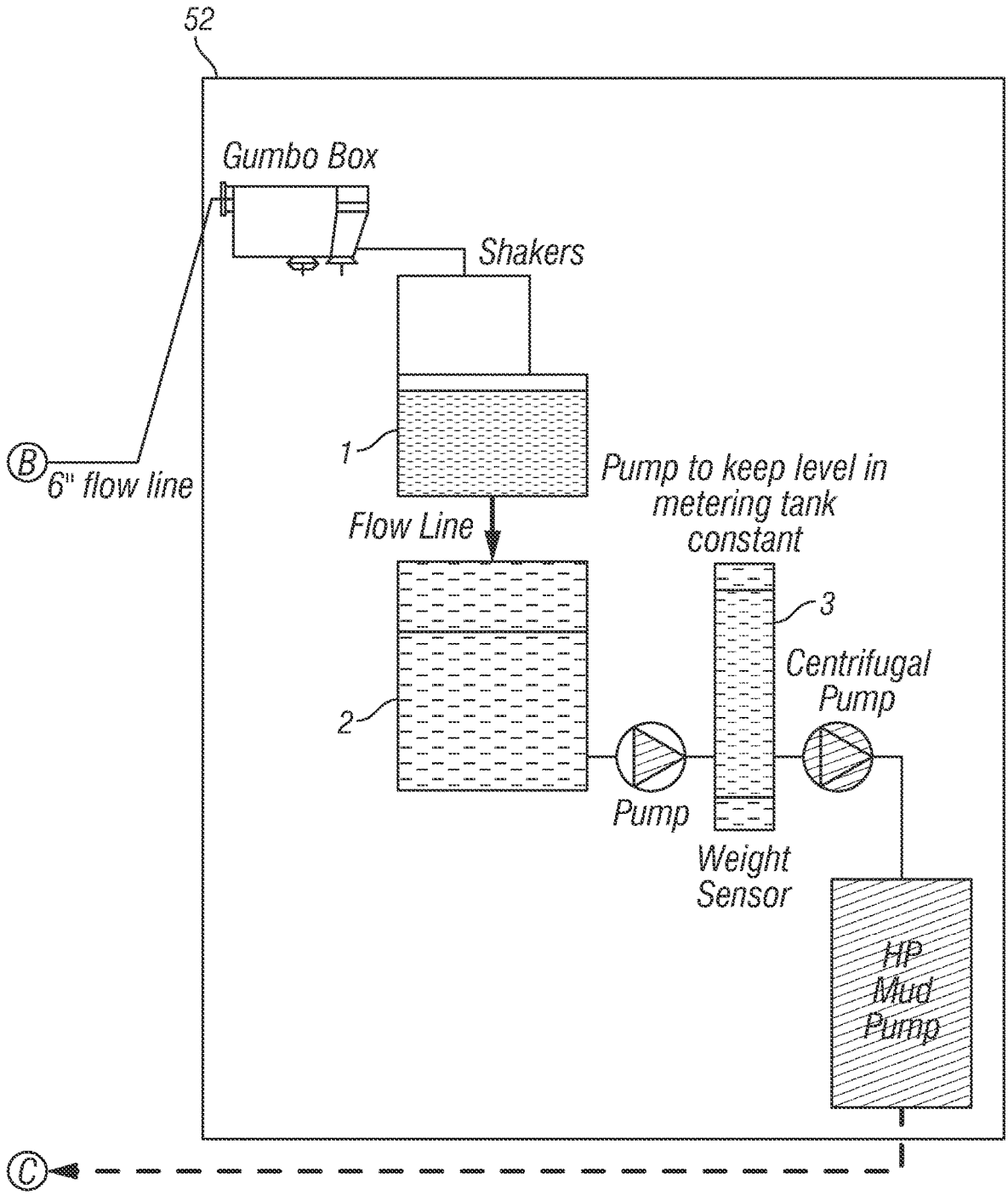

FIG. 1 shows the mud flow during circulating operations. FIG. 2 shows the mud circulation system of FIG. 1, but wherein the mud circulation system is operating during tripping operations, and therefore is not circulating. FIG. 2 also shows, as will be further explained with reference to FIGS. 5 through 7, how returned mud processing equipment may be located away from a well center on a drilling platform using equipment such as shown in FIG. 1.

Figure 3A:
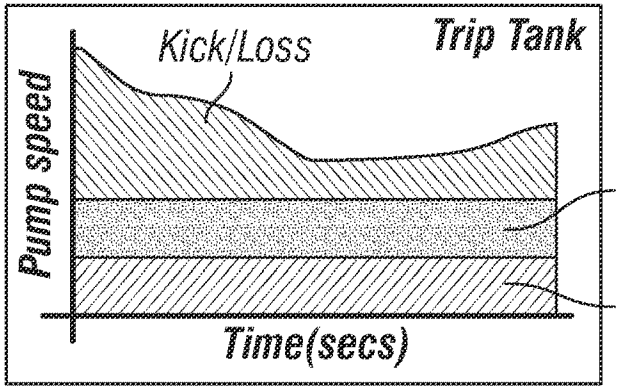
FIGS. 3A and 3B show, respectively a graph of relative mud volumes in a trip tank and in a metering tank in the event of a fluid influx into a wellbore.
Figure 3B:
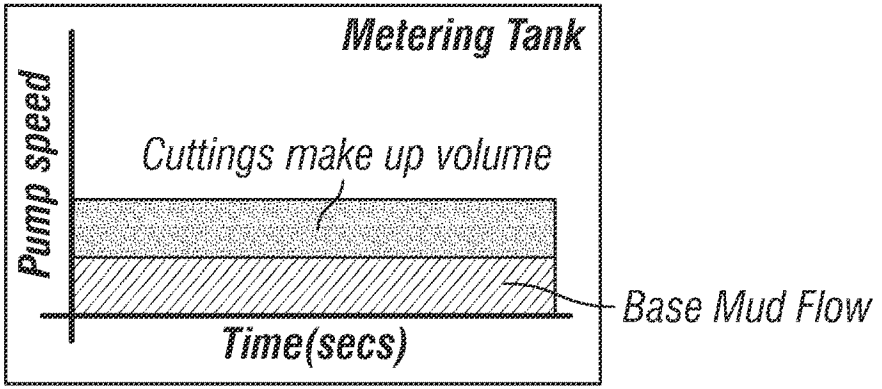

Detecting fluid influx into a wellbore, mud loss from the wellbore and identifying changes in main mud pump 30 efficiency may be performed by the following procedure and as illustrated graphically in FIGS. 3A and 3B. Collectively, the foregoing fluid influx, fluid loss and main mud pump efficiency changes may be referred to collectively as "anomalous mud flow."

At the start of circulating operations, measure ("zero out") the transfer pumps' 24 and 34 operating speeds at the required operating rate of the main mud pumps 30. During normal drilling, where there is no fluid influx or mud loss, both transfer pump flow rates (and corresponding relative speeds) should be identical and around the "zero out" point. As the wellbore length is increased during drilling, correspondingly increased wellbore volume is filled with additional mud, which may be withdrawn from the active volume mud tank 2. The volume of drill cuttings returned to the surface from the wellbore 10 is replaced with a corresponding volume of additional mud transferred from the active volume mud tank 2.

When a fluid influx ("kick") develops, the main rig mud pumps 30 are operating to pump the original flow rate of mud into the wellbore 10 through the pipe string 12. However, the trip tank transfer pump 24 speed will increase because of the increased flow of mud from the wellbore 10 and corresponding increase in the measured weight of the trip tank 22 (or corresponding increase in the measured fluid level in the trip tank 22). Detecting the change in trip tank transfer pump 24 speed is fast and does not have any substantial time delays, because the increase in fluid level in the trip tank 22 is substantially instantaneous as volumetric flow rate of fluid leaving the wellbore 10 will directly correspond to the fluid influx flow rate. As stated previously, the volumetric flow rate of the trip tank fluid transfer pump 24 is directly related to the pump speed. Change in the transfer pump speed, and corresponding determinable change in the transfer pump flow rate, is therefore a good indication of the rate of flow of the fluid influx or "kick". Kick fluid volume will be stored in the active volume mud tank 2, the level or volume measurement of which can be used to estimate the total influx or kick volume. In some embodiments, changes in the fluid level and/or measured weight of the trip tank 22 may be used to estimate the influx or kick volume and kick detection by setting the operating speed of the trip tank transfer pump 24 to a constant value.

Figure 4A:
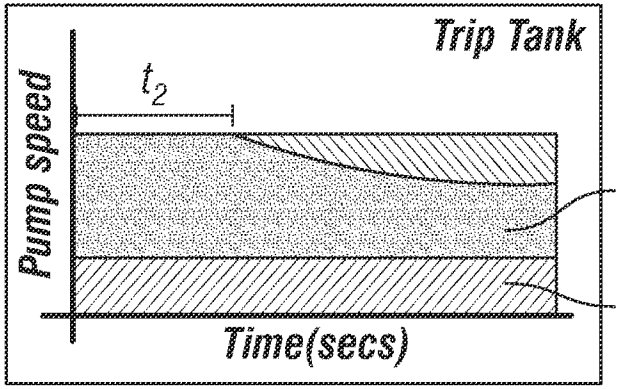
FIGS. 4A and 4B show, respectively, graphs of relative mud volumes in the trip tank an in the metering tank indicative of loss of efficiency in the drilling unit main mud pumps.
Figure 4B:
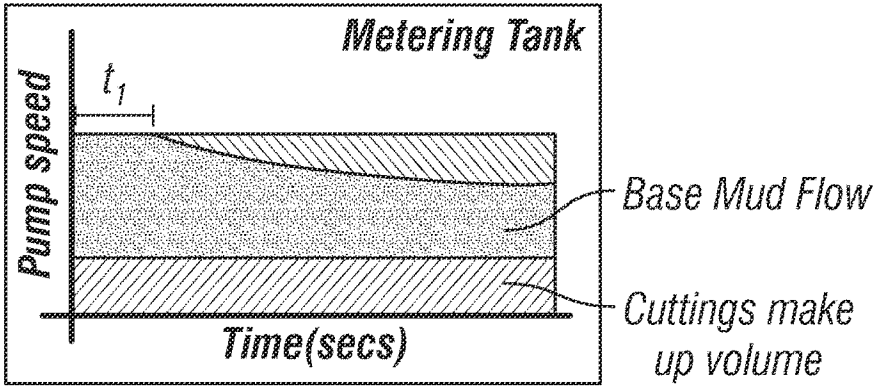

Changes in efficiency of the mud pumps 30 may be performed by the following procedure as illustrated in graphically FIGS. 4A and 4B.

At start of drilling, zero out both the trip tank transfer pump 24 and the metering tank transfer pump 34 speed at the required volumetric flow rate of the main mud pumps 30. During normal drilling both the trip tank transfer pump 24 and the metering tank transfer pump 34 speed should be identical and around the zero point. Increased wellbore volume produced by lengthening the wellbore during drilling is filled with additional mud from the active volume mud tank 2. Likewise, drill cuttings volume after cuttings removal from the mud is replaced with additional mud from the active volume mud tank 2. As main mud pump 30 efficiency decreases, i.e., lower volume of mud is moved at a constant main mud pump operating speed, the main mud pumps 30 draw mud from the metering tank 3 at a lower rate. Metering tank transfer pump 34 speed will decrease to maintain the measured liquid level and/or measured weight in the metering tank 3. A corresponding pump operating speed decrease will occur at the trip tank transfer pump 24, but at a delayed time from the operating speed change at the metering tank transfer pump 34 related to the volume of the wellbore (e.g., related to well depth and casing internal diameter). Detecting the change in metering tank transfer pump 34 speed is fast and does not have any time delays resulting from intervening equipment between the return conduit 14, metering tank 3 and the metering tank transfer pump 34. As previously explained, volumetric flow rate of the metering tank transfer pump 34 is directly related to its operating speed. Thus, change in the operating speed of the metering tank transfer pump 34 can be used as an indicator of efficiency loss of the main mud pumps 30. Main mud pump efficiency loss has a distinctly different pattern in transfer pumps' (24 and 34) operating speeds compared to the patterns caused by fluid influx and/or mud loss making it easy to differentiate such events from each other.

Figure 5:
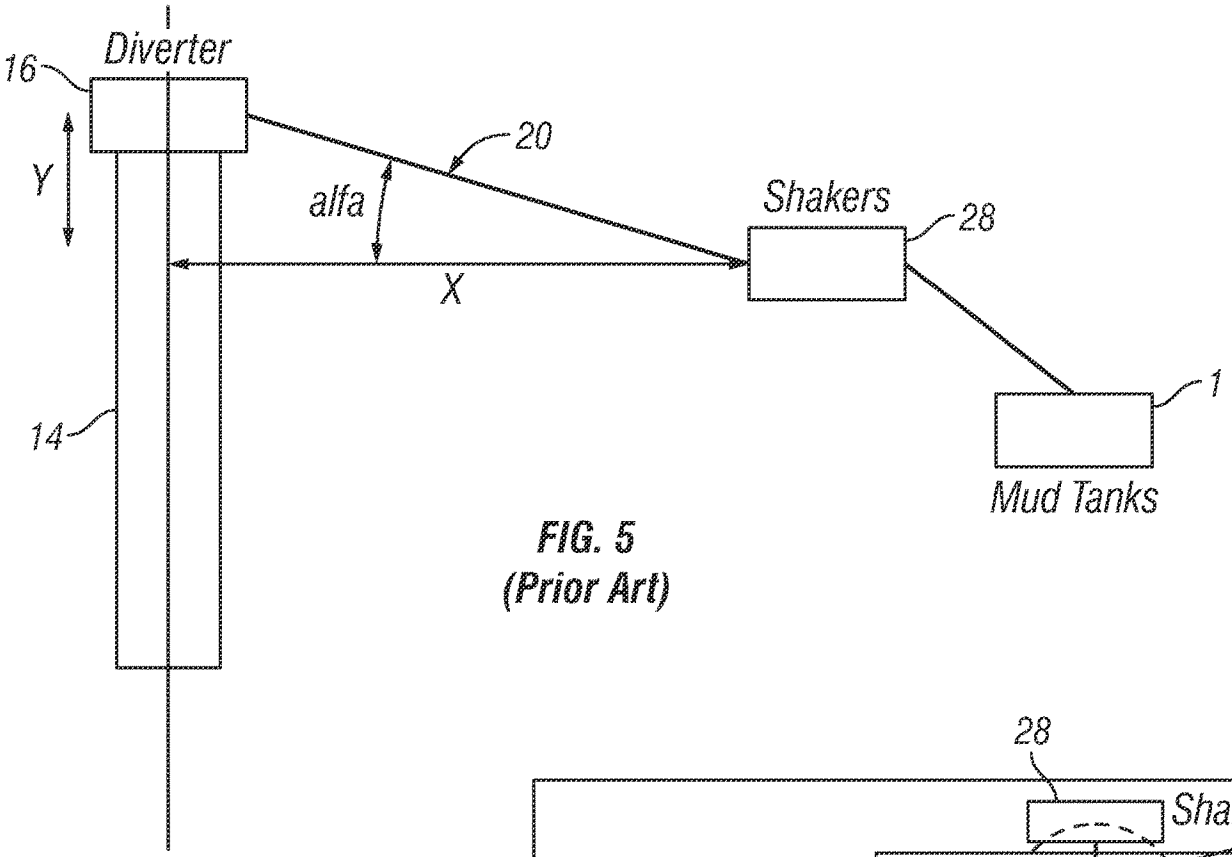
FIG. 5 (Prior Art)
FIG. 5 shows a schematic diagram of mud returned from a wellbore being moved to processing equipment by means of gravity.

Referring once again to FIG. 1, another possible advantage of a drilling mud circulation system according to the present disclosure may be observed. As explained previously, mud returning from the wellbore 10 may enter the diverter 16. In FIG. 1, the gumbo box 18 is shown disposed over the trip tank 22. The existing flow line 20 may extend from the gumbo box 18 to the shakers 28. Referring to FIG. 5, the wellbore 10 or return conduit 14 and diverter 16 are shown as having the diverter 16 elevated by a selected level Y above the elevation of the shakers 28, and the shakers 28 are located at a distance X from the return conduit 14 such that an angle $\alpha$ is subtended by the existing flow line 20. The angle $\alpha$ may be selected such that gravity efficiently moves the returning mud to the shakers 28. Mud discharged through the shakers 28 may enter the mud treatment tank 1.

Figure 6:
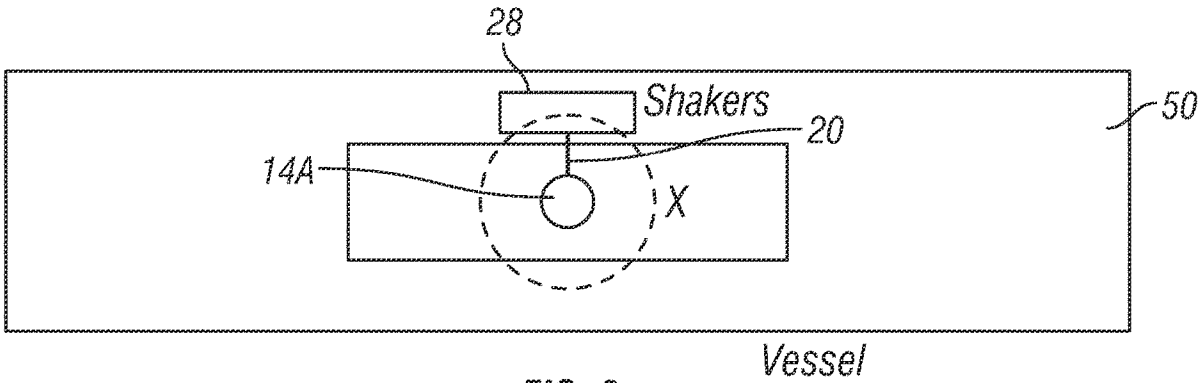
FIG. 6 (Prior Art)
FIG. 6 shows how using gravity to move returned mud may require locating solids extraction equipment proximate to a well center on a drilling unit.

Referring to FIG. 6, in mud circulation systems known in the art prior to the present disclosure, using gravity to move the returned mud to the shakers 28 and then to the mud treatment tank 1 usually constrained the location of the shakers 28 to a position proximate the well center 14A on the drilling platform 50. Gravity operated return mud treatment systems may be subject to certain safety hazards. First, by using gravity to move the returned mud to the treatment system, the returned mud treatment system may be exposed to the atmosphere. Combustible gases may thereby be released from the returned mud to the atmosphere. Second, gravity operation may limit the possible location of the returned mud treatment system with reference to the well center 14A because of fluid friction within the various conduits within the returned mud treatment system. Thus, not only may combustible gases be released to the atmosphere, such release may take place proximate the return conduit (14 in FIG. 5), thus creating additional safety hazards.

Figure 7:
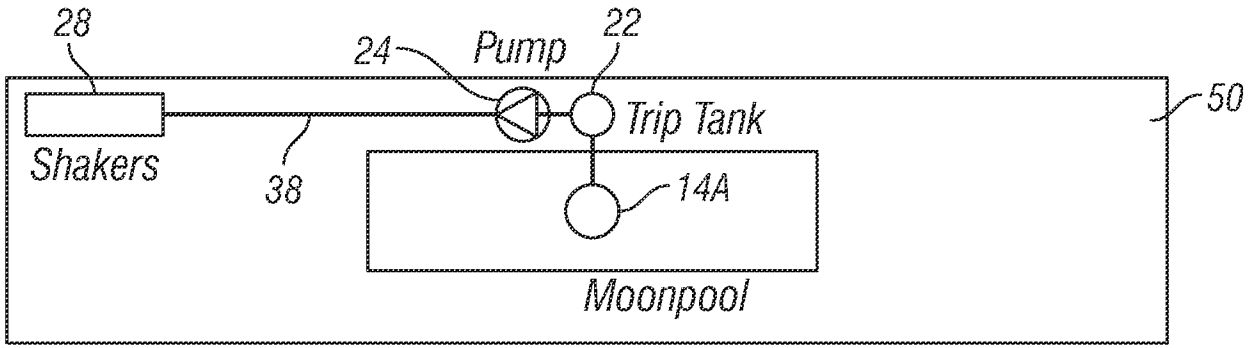
FIG. 7 shows how a system such as shown in FIG. 2 may enable moving returned mud processing equipment away from the well center or at any other desirable location on a drilling platform.

As shown in FIG. 7, by using one or more trip tank transfer pumps 24 to move returned mud to the processing equipment through the flow line 38 extending between the trip tank transfer pump discharge and the gumbo box 18 and shakers 28, it may be possible to move substantially all the returned mud processing equipment, including mud treatment tank 1, degassers (not shown) and other devices used to prepare returned mud for recirculation into the pipe string (12 in FIG. 1) at any suitable location on the drilling platform 50 chosen by the platform designer. Referring briefly to FIG. 2, in some embodiments, all of the return mud treatment equipment may be disposed in a sealed enclosure 52, whereby combustible materials, e.g., gases may be extracted from the returned mud in an environment protected from possible sources of ignition, and then safely vented or otherwise disposed after such extraction.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for identifying anomalous mud flow comprising:

determining an operating rate of a mud pump having an output thereof connected to a pipe string in a wellbore;

moving mud returned from the wellbore displaced by the mud pump through the pipe string to a first metering tank;

moving the returned mud from the first metering tank to a mud storage tank using a first transfer pump having a volumetric flow rate directly related to an operating speed of the first transfer pump;

measuring a first parameter related to volume of mud in the first metering tank;

moving mud from the mud storage tank to a second metering tank using a second transfer pump, the second transfer pump having a volumetric flow rate directly related to an operating speed of the second transfer pump, the second metering tank in fluid communication with an inlet to an inlet of the mud pump;

measuring a second parameter related to volume of mud in the second metering tank; and identifying anomalous mud flow by detecting changes in the measured operating rate of the first transfer pump wherein the first transfer pump operating rate is adjusted to maintain the first parameter substantially constant.

2. The method of claim 1 wherein the anomalous flow comprises fluid influx into the wellbore determined by detecting an increase in the operating speed of the first transfer pump.

3. The method of claim 1 wherein the anomalous flow comprises fluid loss to the wellbore determined by detecting a decrease in the operating speed of the first transfer pump.

4. The method of claim 1 wherein the first parameter comprises a measured fluid level in the first transfer tank.

5. The method of claim 1 wherein the first parameter comprises a weight of the first transfer tank.

6. The method of claim 1 further comprising determining a change in density of mud in the first transfer tank by detecting reduction in the weight while the measured fluid level remains constant.

7. The method of claim 6 further comprising identifying a fluid influx by determining the change in density.

8. The method of claim 1 further comprising detecting anomalous flow by detecting changes in the measured operating speed of the second transfer pump wherein the second transfer pump operating speed is adjusted to maintain the second parameter substantially constant.

9. The method of claim 8 wherein the anomalous flow comprises reduction in efficiency of the mud pump determined by detecting a reduction in operating speed of the second mud pump.

10. The method of claim 8 wherein the second parameter comprises a measured fluid level in the second transfer tank.

11. The method of claim 8 wherein the second parameter comprises a weight of the second transfer tank.

12. The method of claim 1 wherein the first transfer tank comprises a trip tank.

13. The method of claim 1 wherein the operating rate of the mud pump is determined by measuring a pump stroke rate with respect to time.

* * * * *